US006183629B1

(12) United States Patent
Bando et al.

(10) Patent No.: US 6,183,629 B1
(45) Date of Patent: Feb. 6, 2001

(54) PROCESS FOR PRODUCING PETROLEUM RESIDUUM-WATER SLURRY

(75) Inventors: Shoichi Bando, Handa; Makoto Inomata, Yokohama, both of (JP)

(73) Assignee: JGC Corporation, Tokyo (JP)

( * ) Notice: Under 35 U.S.C. 154(b), the term of this patent shall be extended for 0 days.

(21) Appl. No.: 09/276,324

(22) Filed: Mar. 25, 1999

(30) Foreign Application Priority Data

Mar. 27, 1998 (JP) ..... 10-100457

(51) Int. Cl.[7] ..... C10G 1/00

(52) U.S. Cl. ..... 208/426; 208/22; 208/39
(58) Field of Search ..... 208/426, 27, 39

(56) References Cited

U.S. PATENT DOCUMENTS 4,537,600 * 8/1985 Tajima et al. ..... 44/51
4,565,546 * 1/1986 Ohzeki et al. ..... 44/51
4,963,250 * 10/1990 So et al. ..... 208/15
5,498,589 * 3/1996 Schroter et al. ..... 502/416

FOREIGN PATENT DOCUMENTS 62-225592 10/1987 (JP) .

* cited by examiner

*Primary Examiner*—Helane E. Myers
(74) *Attorney, Agent, or Firm*—Webb Ziesenheim Logsdon Orkin & Hanson, P.C.

(57) ABSTRACT

Use is made of a high-speed agitator comprising vessel 2 rotated at a low speed and bladed agitating element 3 rotated at a high speed in direction reverse to that of the vessel 2, the bladed agitating element 3 having a rotary axis arranged parallel to, and located apart from, the rotary axis of the vessel 2. Petroleum residuum such as solvent deasphalting residuum is agitated together with a grinding auxiliary and water in the high-speed agitator so that the petroleum residuum is ground. Thereafter, a dispersant is added thereto to form a slurry and the viscosity thereof is adjusted to a given value. A stabilizer is further added thereto to obtain a stable slurry. The dispersant and the stabilizer may be placed in the high-speed agitator prior to the grinding of the petroleum residuum. Thus, there is provided a process in which a high-concentration petroleum residuum-water slurry with a desirable particle size distribution, being cheap and highly stable, can easily be obtained by a one-stage grinding.

18 Claims, 6 Drawing Sheets

PROCESS FOR PRODUCING PETROLEUM RESIDUUM-WATER SLURRY

FIELD OF THE INVENTION

The present invention relates to a process for producing a petroleum residuum (residue)-water slurry.

BACKGROUND OF THE INVENTION

The mined crude oil tends to be increasingly heavy and, on the other hand, the demand for heavy oil tends to decrease. Therefore, in petroleum refining, it is desirable to crack any produced residual oil as effectively as possible to thereby raise the clean oil yield. Moreover, in accordance with the decrease of natural oil reserves, attention is being drawn to the effective utilization of superheavy crude oil such as oil sand or Orinoco tar.

For example, with respect to the direct utilization of vacuum residual oil, there can be mentioned the use of the vacuum residual oil as a heavy oil prepared by cutting back with gas oil or as road construction base materials. On the other hand, with respect to the method of upgrading the vacuum residual oil, there can be mentioned the method of producing light hydrocarbon such as fluid catalytic cracking, hydrogenation cracking or thermal cracking and the physical separating method in which deasphalted oil (oil from which asphaltene was removed) is extracted with the use of a light hydrocarbon, e.g., propane or butane as a solvent.

As compared with the gravity decrease through cracking, the upgrading through solvent deasphalting is advantageous in that the apparatus is relatively cheap and hydrogen is not used. However, the solvent deasphalting residuum is solid at ordinary temperature, so that the upgrading through solvent deasphalting has the disadvantage that the handling thereof for stocking or transportation is not easy. When the solvent deasphalting residuum is used as a liquid fuel, about 30 to 50% by weight of cracked gas oil is added to the solvent deasphalting residuum so that the viscosity thereof is reduced to the same level as that of heavy oil. However, this method has the drawback that the cracked gas oil obtained by a fluid catalytic cracking of deasphalted oil is used as a cutter stock with the result that the extraction ratio of solvent deasphalting is lowered. Therefore, the water slurry forming technique in which the solvent deasphalting residuum is ground and dispersed in water at a high concentration is drawing attention.

The conversion of coal as a solid fuel to a liquid fuel in the form of a water slurry (Coal Water Mixture; hereinafter also referred to as "CWM") has already been brought into practical use. However, with respect to the heavy carbonaceous residuum from petroleum such as the solvent deasphalting residuum, there are not only peculiar technical problems not experienced in the conversion of coal to a water slurry, for example, the problem that the softening point thereof is so low that the residuum is susceptible to temperature atmosphere to thereby cause the handling to be difficult but also inherent technical problems that cannot be coped with in the same manner as in the production of CWM regarding, for example, the grindability and dispersibility, realizable concentration and product stability in slurry formation. Therefore, research is being promoted toward the practical conversion of the heavy carbonaceous residuum from petroleum to a water slurry.

Generally, the most important technical requirements to be satisfied by the slurry fuel or by the process for producing the same are the capability of preserving the fuel solid component at a high concentration, low slurry viscosity, stability during the storage and transportation and reduction of cost incurred by the grinding energy, apparatus, dispersant,etc. It is desired that all of these requirements be collectively satisfied.

First, with respect to the concentration of fuel solid component among the slurry product characteristics, the below described Japanese Patent Laid-open Publication No. 62(1987)-225592 points out that the closest packing principle common to CWM is believed to be also applicable to the solvent deasphalting residuum-water slurry (Residue-Water Mixture; hereinafter also referred to as "RWM"). That is, when the target apparent viscosity at 20° C. is 1000 centipoise (cP) or less, the practically possible maximum concentration is about 65 to 70% by weight or slightly over the same in terms of fuel solid component concentration. Furthermore, the fluidity and stability of the pumpable water slurry is susceptible to the variety, concentration, particle diameter distribution and dispersion state of fuel solid component particles as the principal component, the variety and amount of added dispersant, the variety and amount of stabilizer for sustaining the stability of the slurry, the mutual functional relationship of all the constituent elements including these, the atmosphere such as temperature, the production conditions, etc.

The preferred particle size distribution of solvent deasphalting residuum for obtaining a slurry with high fluidity while maintaining the fuel solid component at a high concentration is known to be in the form of approximately an inverted W character over the particle diameter range of about 1 to 1000 $\mu$m as shown in FIG. 9. The reason is that particles with small diameters enter gaps among particles with large diameters so that the particles of solvent deasphalting residuum are brought into the closest packed state to thereby enhance the fluidity of the water slurry. On the other hand, when the particle diameters are uniformalized, gaps are formed among the particles, irrespective of the magnitude of the particle diameters, with the result that the closest packed state cannot be realized.

Moreover, although the particle size distribution can be shifted toward the small diameter side (left side of FIG. 9) while maintaining the above form of approximately inverted W character, obtaining such a particle size distribution is practically infeasible in view of the structure of the apparatus for agitating and grinding the solvent deasphalting residuum. For example, when it is intended to prolong the agitation period to thereby reduce the particle size, only the particles with large diameters have their sizes reduced while the particles with small diameters are no longer ground. As a result, the large diameter end of the particle size distribution graph of FIG. 9 is abruptly deviated toward the small diameter side (left side of FIG. 9) so that a sharp peak is realized to result in a degradation of the fluidity of the water slurry. Contrarily, when the particle size distribution is deviated toward the large diameter side (right side of FIG. 9), the amount of particles precipitated in the water slurry is increased because the particle diameters become large to thereby result in a degradation of the long-period stability of the water slurry.

The process for producing the solvent deasphalting residuum-water slurry (RWM) will now be studied. It was anticipated that the typical process employed in the production of coal-water slurry (CWM) would be applicable, as a practical economic process, to the production of RWM. Specifically, it was anticipated that, for example, the one-stage grinding process comprising performing a wet high-concentration fine grinding of coarsely ground raw material in the presence of a dispersant in water, followed by addition of a stabilizer and blending together, would be applicable to the production of RWM.

Therefore, the inventors have attempted to grind the solvent deasphalting residuum with the use of ball mill grinding apparatus having been used in the production of CWM. However, the obtained ground particles have the particle diameter range deviated toward the small diameter side, and the particle size distribution of broad particle diameter range as shown in FIG. 9 has not been obtained. The reason would be attributed to a significant difference in concentration, dispersion state and stability between the water slurry from solvent deasphalting residuum and the water slurry from coal, this difference resulting from a constituent component difference such that the oil content, bubble, heavy metal content and sulfur content of solvent deasphalting residuum are more than those of coal, or a difference therebetween in specific gravity, ground particle configuration and grinding characteristics, or a difference therebetween in slurry forming conditions.

The inventors have accordingly conducted extensive and intensive studies on the grinding of solvent deasphalting residuum with the use of the ball mill grinding apparatus. As a result, it has been found that the particle size distribution with the form of approximately an inverted W character over a broad particle diameter range as shown in FIG. 9 can be obtained by a two-stage grinding.

Two-stage grinding with the use of the ball mill grinding apparatus is unfavorable because the number of steps is increased to thereby increase the production cost with the result that the target of converting the residuum to fuel with minimized cost cannot be attained.

Another technique in which the two-stage grinding is performed is described in Japanese Patent Laid-open Publication No. 62(1987)-225592. In the process of this publication, use is made of a grinding apparatus comprising an oblate cylindrical grinding chamber and, fitted therein at slight spacings from its upper and lower surfaces and circumferential side wall, rotary blades or grinding blades being a combination of rotary blade and fixed blade. Feeds from a hopper are ground by means of this grinding apparatus, and obtained grinds are discharged through a discharge pipe. However, the inventors have empirically seized that the grinds with the desired particle size distribution as shown in FIG. 9 cannot be obtained by grinding the solvent deasphalting residuum by means of the above grinding apparatus. The reason is presumed to be that, in this process, the grinding of the solvent deasphalting residuum is accomplished with the utilization of not only shearing force but also large frictional force, so that a high temperature is realized by the large frictional force when the grinding is conducted by this process to thereby cause part of the solvent deasphalting residuum from vacuum residual oil, whose softening point is generally in the range of about 120 to 200° C., to soften during the grinding.

The present invention has been made in these circumstances. The object of the present invention is to provide a process for easily producing a cheap highly stable petroleum residuum-water slurry at low cost, in which grinds with a desirable particle size distribution are obtained from a petroleum residuum such as solvent deasphalting residuum by a one-stage slurry forming step.

SUMMARY OF THE INVENTION

The process for producing a petroleum residuum-water slurry according to the present invention comprises the steps of:

charging petroleum residuum into a high-speed agitator having a vessel equipped, at its bottom, with at least one agitating element, and rotating the agitating element at a high speed to thereby grind the petroleum residuum, wherein not only are water and a dispersant added to the petroleum residuum prior to, during or after the grinding of the petroleum residuum but also a grinding auxiliary is added to the petroleum residuum prior to or during the grinding of the petroleum residuum, followed by agitation together with the petroleum residuum, thereby obtaining a petroleum residuum-water slurry.

This process is suitable to the slurry formation from the petroleum residuum having a softening point of 120 to 200° C., especially a residuum obtained by subjecting a vacuum residual oil to a solvent deasphalting. It is preferred that the vessel of the high-speed agitator be rotated in a direction reverse to that of the agitating element and that the agitating element have a rotary central axis located apart from a central axis of the vessel of the high-speed agitator. Further, it is preferred that a central axis of the vessel of the high-speed agitator and a rotary central axis of the agitating element be arranged in substantially parallel relationship to each other and both inclined. Still further, it is preferred that the vessel of the high-speed agitator have a corner fitted with a partition capable of preventing retention of the petroleum residuum.

The obtained petroleum residuum-water slurry preferably contains, for example, particles whose diameter is not greater than 5.5 $\mu$m in an amount of 15 to 40% by weight and particles whose diameter is not greater than 710 $\mu$m in an amount of at least 80% by weight. During the production of the petroleum residuum-water slurry, the water is preferably added in an amount of 25 to 50% by weight based on the total of the petroleum residuum and water. It is preferred that the process for producing a petroleum residuum-water slurry according to the present invention further comprise the step of passing the obtained petroleum residuum-water slurry through a strainer and also further comprise the step of adding a stabilizer to the obtained petroleum residuum-water slurry.

DETAILED DESCRIPTION OF THE INVENTION

The present invention will be described in detail below.

Figure 1:
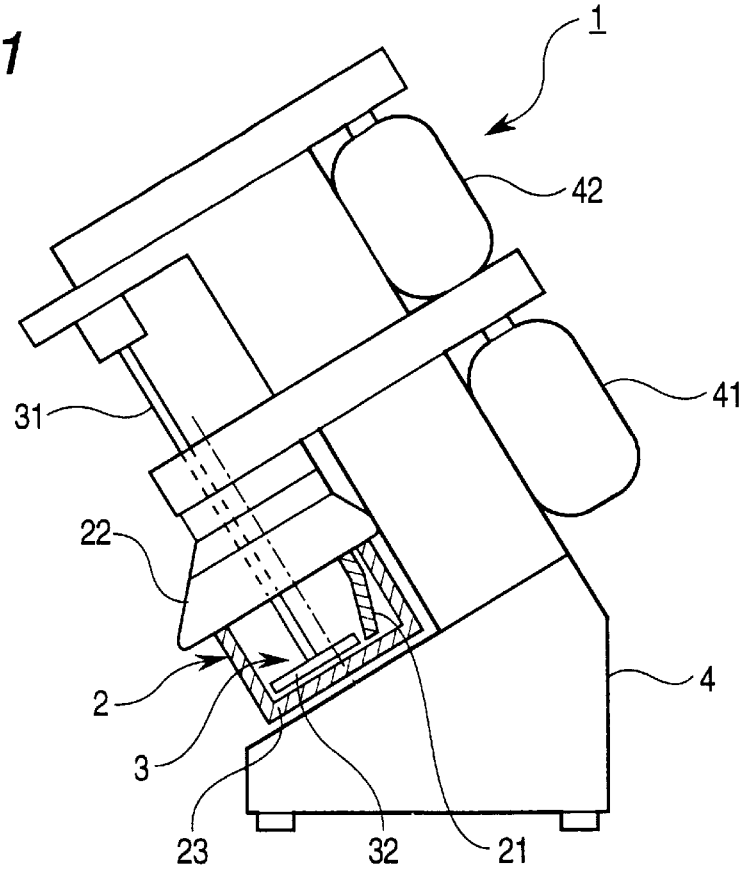
FIG. 1 is a partial sectional view showing one form of high-speed agitator for use in the present invention.
Figure 2:
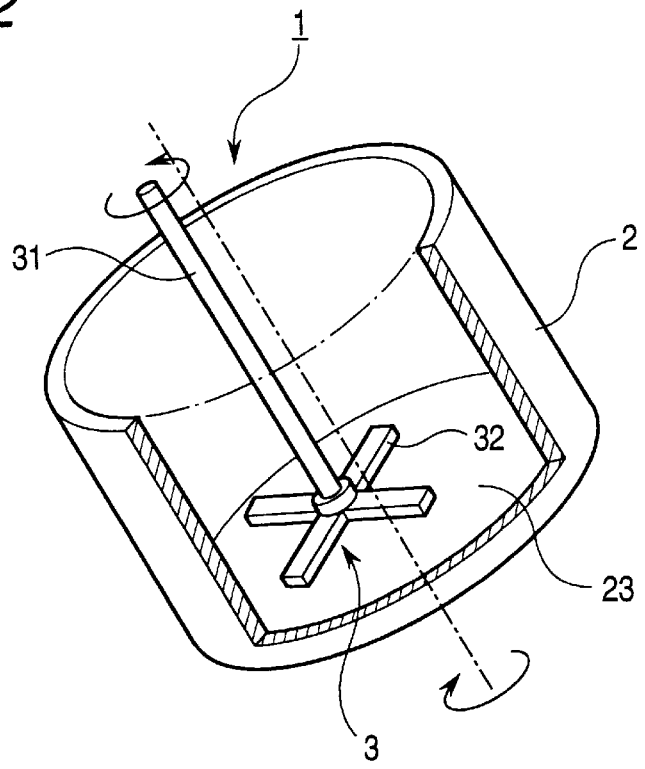
FIG. 2 is a perspective view showing a vessel and an agitating element fitted in one form of high-speed agitator for use in the present invention.

FIGS. 1 and 2 show one form of high-speed agitator for use in the process for producing a petroleum residuum-water slurry according to the present invention. This high-speed agitator 1 comprises vessel 2, which has the shape of a cylinder fitted with a bottom and is rotated at a relatively low speed on a central axis thereof as a rotary axis (indicated by alternate long and short dash lines in FIGS. 1 and 2) to thereby constitute an agitation vessel, and agitating element 3, which is rotated at a high speed in direction reverse to that of the vessel 2. For example, the vessel 2 is supported, with its central axis inclined, by means of pedestal 4. The angle of inclination of the central axis is preferably about 30° or less, for example, 10 to 15° or less. For preventing the petroleum residuum such as solvent deasphalting residuum from being retained without being agitated, partition member 21 is preferably disposed inside the vessel 2 at a corner part above the central axis of the vessel 2. The partition member 21 can be secured to, for example, cover 22 of the vessel 2.

The agitating element 3 can be shaped into, for example, shaft 31 fitted with four blades 32 extending in radial directions as shown in FIG. 2. The shaft 31, namely the rotary axis of the agitating element 3, is preferably arranged parallel to the rotary axis of the vessel 2. Further, it is preferred that the shaft 31 be arranged at a position shifted backward, forward, rightward or leftward from the rotary axis of the vessel 2, that is, at a position eccentric from the central axis of the vessel 2. The shaft 31 arranged at such a position is supported by means of the pedestal 4. It is preferred that the interstice between the distal end portions of the agitating element 3 and the inner wall of the vessel 2 be minimized as long as the grinding effect and power cost are advantageous, and the degree of the eccentricity is appropriate if it satisfies this condition. The interstice is preferably, for example, 30 cm or less although depending on the size of the agitator apparatus. The blades 32 of the agitating element 3 are positioned near bottom 23 of the vessel 2, so that particles of the petroleum residuum such as solvent deasphalting residuum, descending from the upper part of the vessel 2 inside the vessel 2, can effectively be agitated. Motors 41,42 for rotating the vessel 2 and the agitating element 3 are secured to the pedestal 4.

The vessel 2 may be horizontally supported so that the central axis thereof is vertical. In this instance, it is preferred that, for example, a partition member be disposed at corner bottom parts of the vessel 2 to thereby prevent the petroleum residuum such as solvent deasphalting residuum from being retained without being agitated at the corner parts of the vessel 2. With respect to the agitating element 3, the shaft 31 may be fitted with two or more rows of blades therealong, and the number of blades may be 3 or less, or 5 or more. Further, one end of the shaft 31 may be fitted with a disk member arranged at right angles therewith, the disk member fitted with blades, for example, parallel to the shaft 31 along the periphery of the disk member. Still further, the high-speed agitator 1 may be fitted with two or more agitating elements 3. For example, two shafts 31 are arranged at two positions located apart from the central axis of the vessel 2, and each of the shafts 31 is fitted with blades 32.

Figure 3:
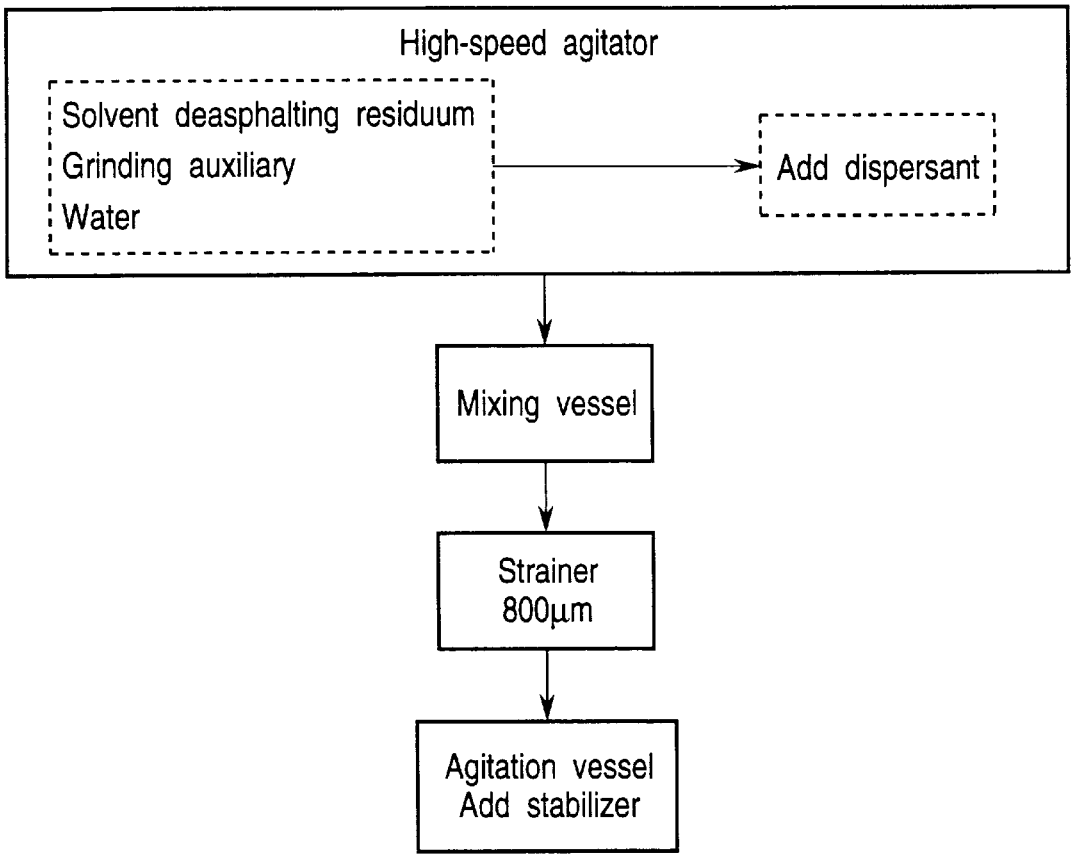
FIG. 3 is a process flow chart showing one working mode of the process of the present invention.

Various working modes of the process for producing a petroleum residuum-water slurry according to the present invention in which use is made of the above high-speed agitator 1 shown in FIGS. 1 and 2 will now be described with reference to FIGS. 3, 4 and 5. In the working mode of FIG. 3, first, the petroleum residuum such as solvent deasphalting residuum and appropriate amounts of a grinding auxiliary and water are charged into the vessel 2 as an agitation vessel of the high-speed agitator 1. The solvent deasphalting residuum is generally flaky. The addition of the grinding auxiliary prior to, or at an initial stage of, the grinding of the petroleum residuum such as solvent deasphalting residuum is preferred because not only is the grindability enhanced to thereby enable obtaining a broad particle size distribution but also the amount of dispersant added in a later step for conversion to a slurry at a later stage can be reduced.

As the petroleum residuum charged as a raw material, there can be mentioned, for example, a solvent deasphalting residuum obtained as a residuum when asphalt and resin contents are separated off from vacuum residual oil in accordance with the solvent extraction technique to thereby produce a deasphalted oil of high added value. When the deasphalted oil of desirable properties is obtained at a relatively high extraction ratio, the yield of deasphalted oil is generally in the range of 40 to 80% by weight based on vacuum residual oil. The softening point of pitch of solvent deasphalting residuum obtained as a by-product in this instance is in the range of about 120 to 200° C. For example, the solvent deasphalting residuum exhibiting the above softening point of 120 to 200° C. is preferably used as the petroleum residuum charged in the vessel 2.

With respect to the grinding conditions, the peripheral velocity of the agitating element 3 of the high-speed agitator 1 is preferably, for example, about 10 to 42 m/sec, and the rotating speed of the vessel 2, for example, about 10 to 44 rpm. When the rotating speed of the agitating element 3 is too high, the particle size distribution is unfavorably deviated toward the fine particle side. The grinding period is preferably, for example, in the range of about 5 to 60 min although depending on the rotating speed of the agitating element 3, the presence or absence of the grinding auxiliary and dispersant, etc. In the experiments conducted using the solvent deasphalting residuum as a raw material, the inventors have found that the change of the particle size distribution of solvent deasphalting residuum was no longer observed after the grinding period passed about 15 min and that continuing the grinding for an extremely prolonged period of time resulted in a phenomenon of granulation.

It is preferred that the amount of water added for the grinding be generally in the range of about 25 to 50% by weight, especially about 25 to 30% by weight, based on the total of petroleum residuum such as solvent deasphalting residuum and water.

At least one thickener as a viscosity increasing agent selected from among carboxymethylcellulose (CMC), hydroxyethylcellulose (HEC), polyvinyl alcohol, polyethylene glycol and the like can preferably be used as the grinding auxiliary. It is preferred that the amount of added grinding auxiliary be generally in the range of about 50 to 3000 ppm by weight, especially about 100 to 1000 ppm by weight, based on the total of petroleum residuum such as solvent deasphalting residuum and water. The ground petroleum residuum, for example, ground solvent deasphalting residuum is generally in the form of wet powder.

Subsequently, a given amount of dispersant is charged in the high-speed agitator 1, and the high-speed agitator 1 is further driven for about 5 min to thereby liquefy the petroleum residuum of wet powder form. The viscosity thereof is regulated to thereby obtain a slurry.

Any of various surfactants such as anionic surfactants and nonionic surfactants can be suitably used as the dispersant.

Preferred examples of the anionic surfactants include salts, especially calcium, magnesium and sodium salts, of lignin sulfonic acid; partially desulfonated lignin sulfonic acid salts having functional groups such as sulfonic acid, carboxyl, phenolic hydroxyl and alcoholic hydroxyl groups; salts, especially sodium and magnesium salts, of naphthalenesulfonic acid; salts, especially sodium salts, of polystyrenesulfonic acid; and naphthalenesulfonic acid/formaldehyde condensate (NSF) and sodium and magnesium salts thereof. Of these anionic surfactants, naphthalenesulfonic acid/formaldehyde condensate and polystyrenesulfonic acid salts are especially preferred because of the advantages that the change of performance caused by temperature change is slight, that no adverse influence is exerted on the grinding auxiliary and that the addition amount required for conversion to a slurry is small.

Preferred examples of the nonionic surfactants include polyoxyethylene octylphenyl ether, polyoxyethylene cetyl ether, polyoxyethylenesorbitan monolaurate and polyoxyethylenesorbitan monopalmitate. Generally, the nonionic surfactants have the advantage that the lipophilicity thereof is so high that the conversion of the petroleum residuum such as solvent deasphalting residuum to a slurry can extremely be promoted, although they tend to foam and suffer from an extensive performance change by temperature change.

In the present invention, at least one member selected from among these various surfactants can be used as the dispersant. The amount of dispersant added is preferably in the range of about 2 to 20 g, still preferably about 3 to 10 g, per kg of the petroleum residuum such as solvent deasphalting residuum.

After the slurry formation, the obtained slurry is taken out from the high-speed agitator 1 and temporarily placed in an intermediate tank as a mixing vessel. The slurry placed in the intermediate tank is filtered through, for example, a strainer. This filtration separates particles of the petroleum residuum such as solvent deasphalting residuum having a diameter of, for example, greater than about 800 $\mu$m Thus, petroleum residuum particles with large diameters which are likely to precipitate in the slurry can be removed.

In case the grinding is sufficient, the step of passing the obtained petroleum residuum-water slurry through a strainer can be omitted.

The slurry having undergone the filtration is placed together with a given amount of stabilizer in an agitation vessel and is allowed to stand still for, for example, about 10 min to thereby stabilize the slurry.

As the above stabilizer, preferred use can be made of at least one stabilizer (1) selected from the group consisting of carboxymethylcellulose (CMC), hydroxyethylcellulose (HEC), polyvinyl alcohol and polyethylene glycol; one or two stabilizers (2) selected from the group consisting of sodium hydroxide and potassium hydroxide; or at least one stabilizer (3) selected from the group consisting of magnesium hydroxide, magnesium oxide, colloidal silica, kaolin, bentonite and attapulgus clay. The amount of stabilizer added is preferably in the range of about 100 to 6000 ppm by weight, still preferably 500 to 3000 ppm by weight, based on slurry weight.

Thereafter, the stabilized slurry is transferred to another tank such as service tank. The above petroleum residuum particles having a large diameter of, for example, 800 $\mu$m or greater, separated by the strainer or the like, can be recycled as the petroleum residuum raw material to be charged together with water, etc. into the high-speed agitator and ground.

Figure 4:
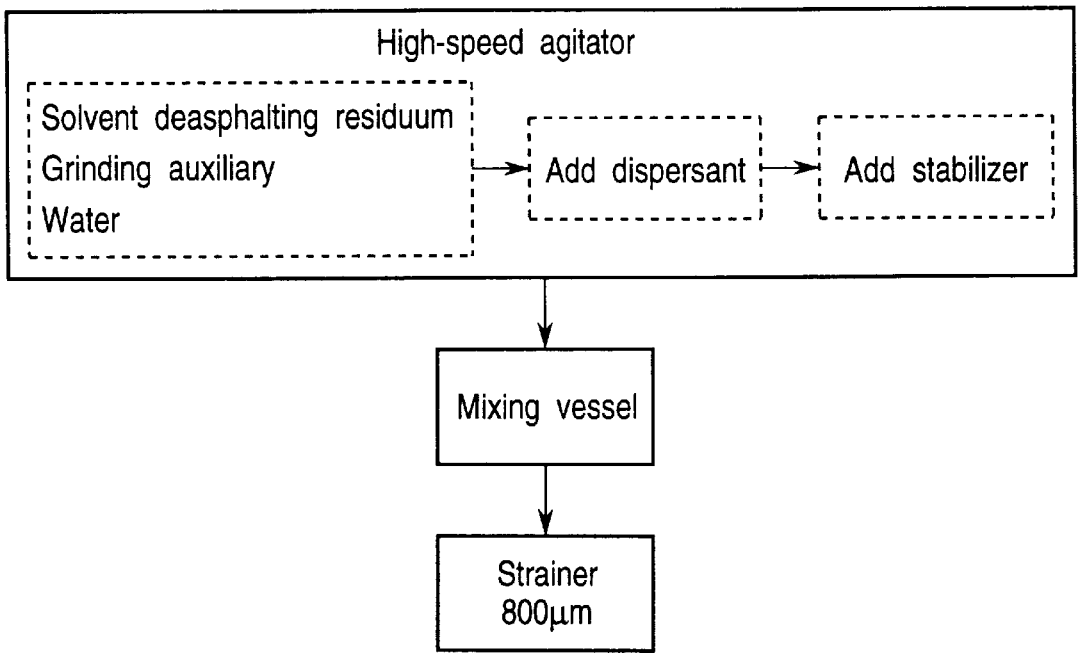
FIG. 4 is a process flow chart showing another working mode of the process of the present invention.

Further, as shown in FIG. 4 being another flow chart, the process for producing a petroleum residuum-water slurry according to the present invention may comprise first obtaining wet-powder grinds, secondly charging a dispersant in the high-speed agitator 1, driving the agitating element of the high-speed agitator 1 for, for example, about 4 min to thereby form a slurry, further charging a given amount of stabilizer in the high-speed agitator 1 and driving the agitating element for, for example, about 1 min to thereby stabilize the slurry.

Figure 5:
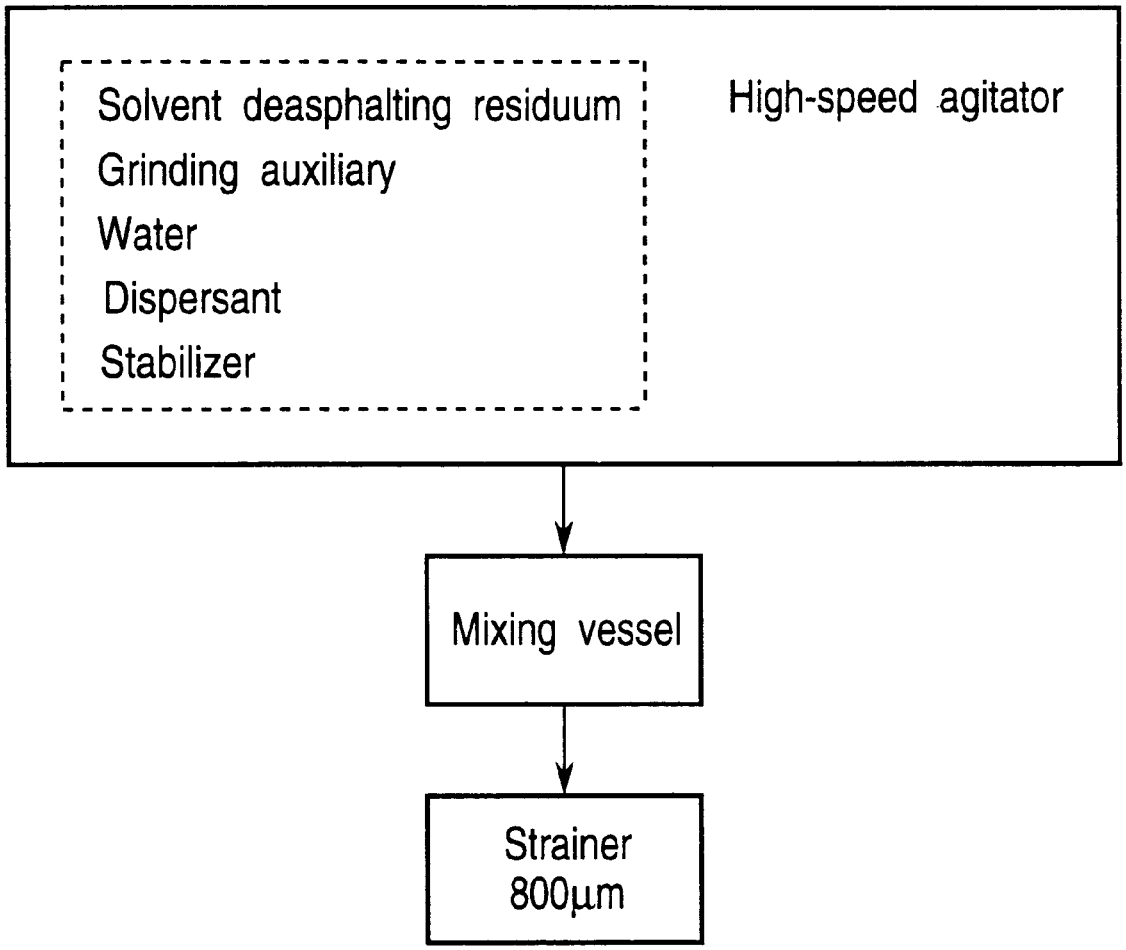
FIG. 5 is a process flow chart showing a further working mode of the process of the present invention.

Still further, as shown in FIG. 5 being still another flow chart, the process for producing a petroleum residuum-water slurry according to the present invention may comprise first charging the petroleum residuum such as solvent deasphalting residuum, a grinding auxiliary, water, a dispersant and a stabilizer in the high-speed agitator 1 and then driving the agitating element 3 to thereby form a slurry.

Figure 6:
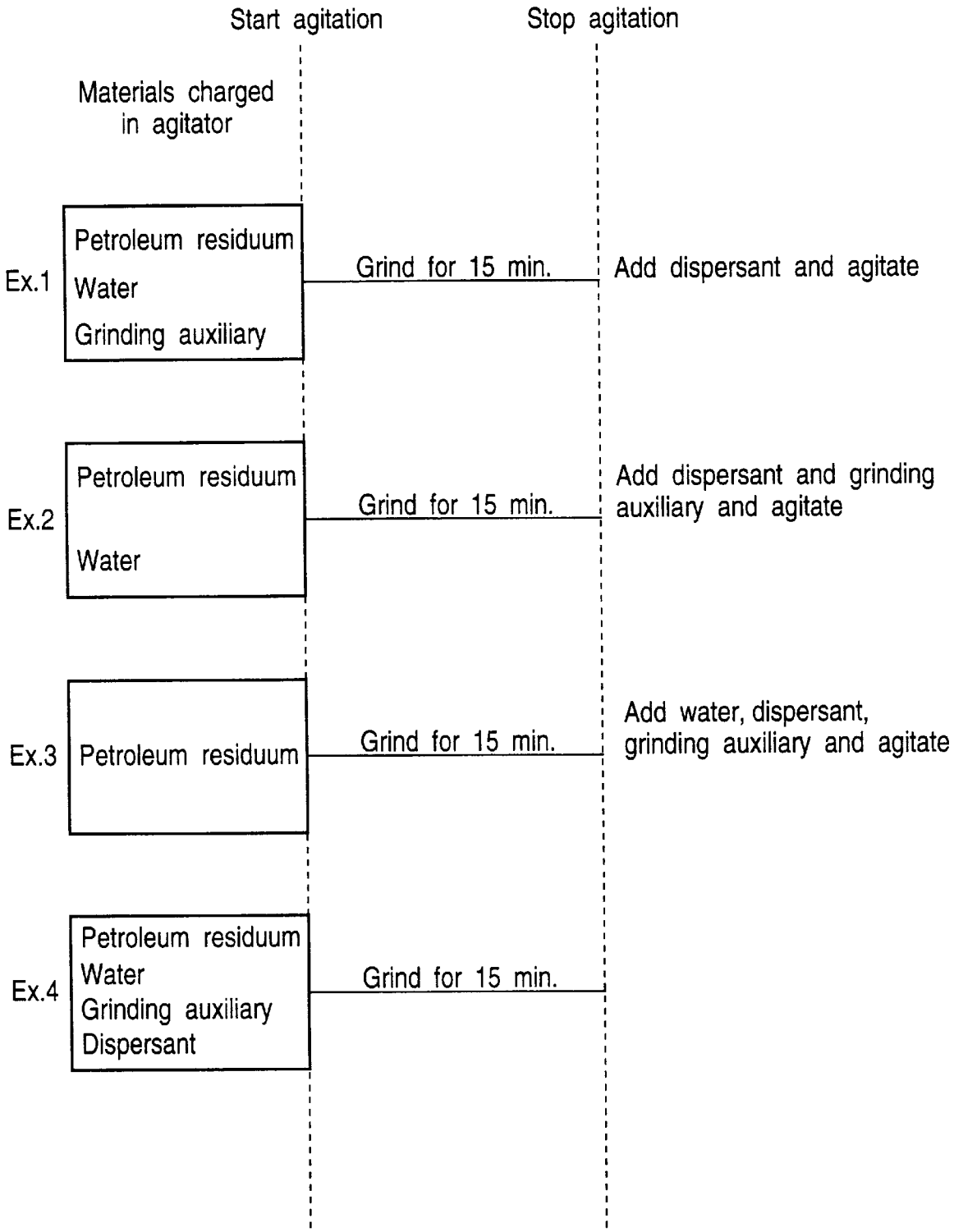
FIG. 6 is a diagrammatic explanatory view showing the timing of charging of water, a grinding auxiliary and a dispersant.

FIG. 6 shows timing modes 1 to 4 for charging water, a grinding auxiliary and a dispersant in the vessel 2 as an agitation vessel in the present invention. In timing mode corresponding to the above working mode of FIG. 3, the petroleum residuum such as solvent deasphalting residuum, water and the grinding auxiliary are first charged in the high-speed agitator and ground for a given period of time (for example, 15 min as described in the chart), followed by the addition of the dispersant. In timing mode 2, only the petroleum residuum such as solvent deasphalting residuum and water are first charged in the high-speed agitator and ground for a given period of time, followed by the addition of the grinding auxiliary and dispersant. In timing mode 3, only the petroleum residuum such as solvent deasphalting residuum is first charged in the high-speed agitator and ground for a given period of time, followed by the addition of the water, grinding auxiliary and dispersant. In timing mode 4, the petroleum residuum such as solvent deasphalting residuum, water, the grinding auxiliary and the dispersant are first charged in the high-speed agitator and ground for a given period of time.

Figure 9:
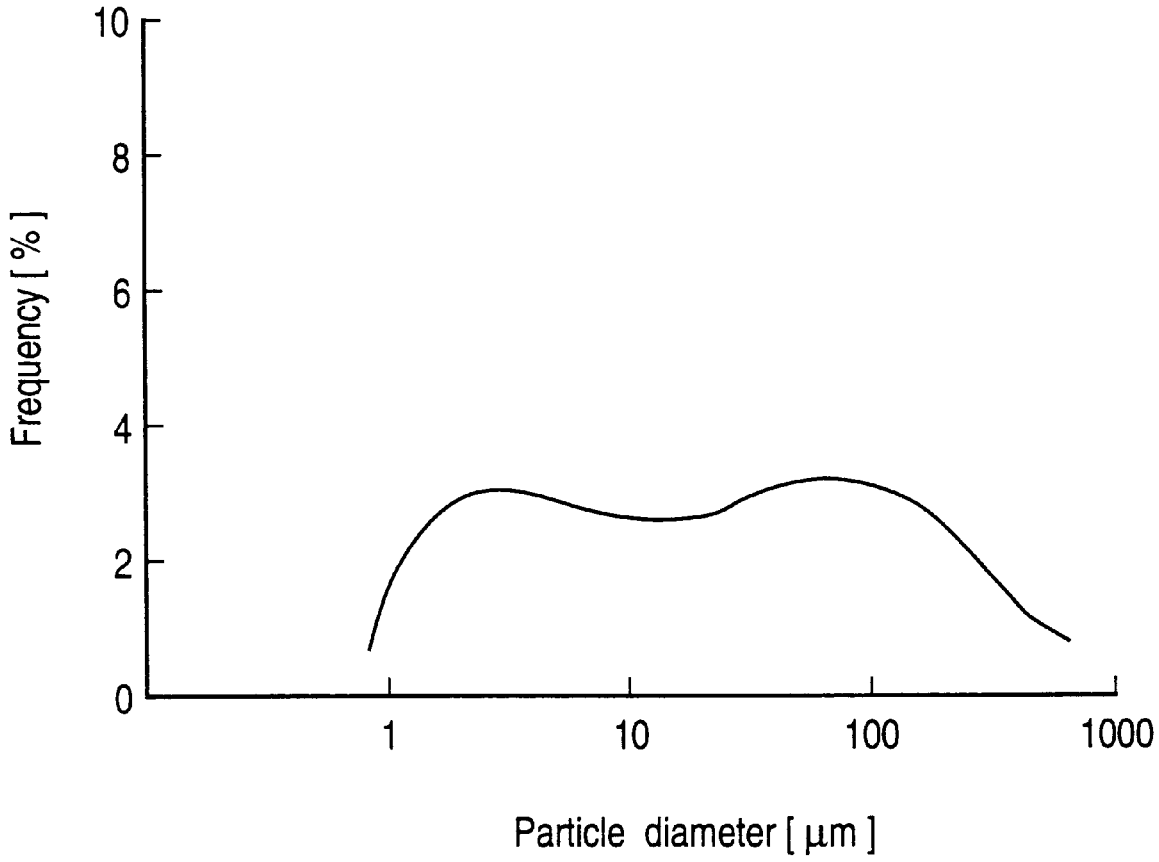
FIG. 9 is a graph showing an ideal particle size distribution.

The inventors' experiments showed that, in the above timing modes 1 to 3 of FIG. 6, the particle frequency gradually decreases until nil at the large-diameter-side on the obtained slurry particle size distribution diagram. That is, a gradual particle size distribution diagram as shown in FIG. 9 mentioned hereinbefore is obtained in the timing modes 1 to 3. By contrast, in the timing mode 4, the particle frequency on the large diameter side is high as compared with those of the timing modes 1 to 3. On the obtained slurry particle size distribution diagram, the peak of particle size distribution is deviated toward the large diameter side but the particle frequency sharply decreases until nil at the large-diameter-side foot part. As apparent from the above, the particle size distribution can be regulated by the timing of charging the grinding auxiliary and the dispersant, so at a slurry exhibiting a particle size distribution whose peak configuration and large-diameter-side foot part configuration are brought into appropriate states on the particle size distribution diagram can be produced.

Accordingly, in the above working modes, the petroleum residuum such as solvent deasphalting residuum is ground by collision with the agitating element by means of the agitator comprising the vessel having its bottom part fitted with the agitating element. Therefore, desired particle size distribution is obtained by one-stage grinding, so that a cheap highly stable high-concentration petroleum residuum-water slurry can be easily produced. This process is suitably employed when the petroleum residuum is solvent deasphalting residuum, especially when it is solvent deasphalting residuum having a softening point of 120 to 200° C. The reason is that, in the process of the present invention, the grinding exhibits low calorific value, so that the softening does not occur even when the softening point of the petroleum residuum is as low as about 120° C. and desirable grinding can be effected when the softening point is in the range of 120 to 200° C.

With respect to the particle size distribution of obtained grinds, it is preferred that the proportion of produced 5.5 μm or less particles be in the range of 15 to 40% by weight and the proportion of produced 710 μm or less particles be 80% by weight or more. When the proportion of produced 5.5 μm or less particles is less than 15% by weight and the particle size distribution on the fine particle side is not gradual, the fluidity of the slurry is unfavorably low. On the other hand, when the proportion of produced 5.5 μm or less particles is greater than 40% by weight, the amount of coarse particles is reduced to thereby uniformalize the particle diameters also with the result that the fluidity of the slurry becomes poor. Furthermore, when the proportion of produced 710 μm or less particles is less than 80% by weight, not only does the combustion efficiency become poor but also the passage through a fuel feed nozzle becomes difficult.

The reason for the realization of the above desirable particle size distribution attained by the process of the present invention would be the interaction of shear force produced by violent vortex and impact force produced between the agitator and the particles, which would result from the high-speed agitation effected by the agitating element 3 fitted to the bottom of the vessel 2 of the high-speed agitator 1.

Moreover, it is presumed that, when not only is the vessel 2 rotated but also the shaft 31 of the agitating element 3 is located apart from the central axis of the vessel 2, nonuniform flow is produced with the result that uniform grinding action can be attained. Namely, if the central axis of the vessel 2 agreed with the rotary axis of the agitating element 3 to thereby produce uniform flow, large shear force would constantly act on part of the slurry while only small shear force would act on another part of the slurry. In contrast, when nonuniform flow is produced, substantially the same level of shear force will act on every part of the slurry when viewed through the agitation period, this is also considered to be a cause of the realization of the desirable particle size distribution.

When the partition member 21 is disposed inside the vessel 2 at a corner part above the center of the bottom of the vessel 2, the retention of particles at the corner part of the vessel 2 can be prevented to thereby attain high grinding performance, this also considered to be a cause of the realization of the desirable particle size distribution.

In the present invention, desired broad particle size distribution is obtained by one-stage grinding, so that a cheap highly stable high-concentration petroleum residuum-water slurry, especially solvent deasphalting residuum-water slurry, of high fluidity can be easily produced.

EXAMPLE

The present invention will now be described in greater detail to thereby clarify the characteristic features of the present invention with reference to the following Examples, which in no way limit the scope of the invention.

The petroleum residuum used as a raw material in the following Examples and Comparative Examples was solvent deasphalting residuum which was procured from a typical oil refinery processing crude oil from the Middle East. The composition and properties of the solvent deasphalting residuum were as follows:

calorific value: 9610 cal/g measured in accordance with the Japanese Industrial Standard M8814 (1993), ash content: 0.5% by weight measured in accordance with the Japanese Industrial Standard M8812 (1993), carbon: 84.2% by weight measured in accordance with the Japanese Industrial Standard M8813 (1988), hydrogen: 8.46% by weight measured in accordance with the Japanese Industrial Standard M8813 (1988), nitrogen: 1.16% by weight measured in accordance with the Japanese Industrial Standard M8813 (1988), oxygen: 0.3% by weight measured in accordance with the Japanese Industrial Standard M8813 (1988), total sulfur: 5.42% by weight measured in accordance with the Japanese Industrial Standard M8813 (1988), softening point: 142.5° C. measured in accordance with the Japanese Industrial Standard K2207 (1993), and HGI (Hard Globe Index): 155 measured in accordance with the Japanese Industrial Standard M8801 (1993).

In the following Examples, use was made of the high-speed agitator of the same construction as shown in FIGS. 1 and 2 (maximum rotating speed: 5000 rpm). The inside diameter of the vessel 2 was 26 cm, the height of the vessel 2 from the bottom to the top (length in axial direction) was 26 cm, and the blade outside diameter and width were 14 cm and 1.5 cm, respectively. The inclination angle was about 10°, and the interstice between blade distal end and vessel inside wall was about 10 mm.

Example 1

For preparing 3000 g of a slurry, only 2160 g of the solvent deasphalting residuum was first charged in the high-speed agitator, and grinding was performed for 40 min under conditions such that the rotating speed of the agitating element and the rotating speed of the vessel were 2082 rpm and 44 rpm, respectively. The obtained grinds were powdery and 100% consisted of the solvent deasphalting residuum. with respect to the obtained grinds, Table 1 lists the particle yield, proportion of particles surviving so as to have a particle diameter of 710 μm or greater (row "+710 μm"), proportion of particles finely ground so as to have a particle diameter of 5.5 μm or less (row "−5.5 μm"), and particle size distribution and average volume particle diameter of particles having a diameter of less than 710 μm. With respect to the particle size distribution, the rows "10%", "50%" and "90%" indicate the diameters of particles whose cumulative values are 10% by weight, 50% by weight and 90% by weight, respectively, in the recovery of particles in the order of from low-diameter particles to large-diameter particles.

It was found from the results that desirable grinds having a broad particle size distribution were obtained.

Example 2

For preparing 3000 g of a slurry, 2160 g of the solvent deasphalting residuum together with 28% by weight, based on the total amount of solvent deasphalting residuum and water, of water were first charged in the high-speed agitator, and grinding was performed for 30 min under conditions such that the rotating speed of the agitating element and the rotating speed of the vessel were 2082 rpm and 44 rpm, respectively. The obtained grinds were powdery, and the concentration of the solvent deasphalting residuum was 74.0%. With respect to the obtained grinds, Table 1 lists the particle yield, proportion of particles surviving so as to have a particle diameter of 710 μm or greater, proportion of particles finely ground so as to have a particle diameter of 5.5 μm or less, and particle size distribution and average volume particle diameter of particles having a diameter of less than 710 μm.

It was found from the results that desirable grinds having a broad particle size distribution in which particles having a diameter of 5.5 μm or less were produced in an amount of more than 20% by weight and in which the diameter of particles whose cumulative value of particle size distribution was 90% by weight was as great as 180 μm were obtained in a short period of time.

Thereafter, to the obtained grinds, NSF (naphthalenesulfonic acid/formaldehyde condensate) as a dispersant was added in an amount of 9 g per kg of solvent deasphalting residuum, CMC (carboxymethylcellulose) as a grinding auxiliary (thickener) was added in an amount of 300 ppm by weight based on the total amount of solvent deasphalting residuum and water, and attapulgus clay as a stabilizer was added in an amount of 2000 ppm by weight based on the slurry, and agitated. Thus, a viscosity regulation and a stabilization were effected, thereby obtaining a slurry. With respect to the obtained slurry, the concentration of solvent deasphalting residuum and the apparent viscosity are listed in Table 2.

185 g of obtained slurry was harvested in a tall beaker of inside volume 300 ml and vibrated for 24 hr by a vibrator under conditions such that the lateral vibration width and vibration frequency were 50 mm and 145 vibrations/min, respectively. The resultant slurry was discharged for 5 min, and the degree of precipitation was evaluated. The results are also given in Table 2.

Example 3

For preparing 3000 g of a slurry, 2160 g of the solvent deasphalting residuum together with 28% by weight, based on the total amount of solvent deasphalting residuum and water, of water and 300 ppm by weight, based on the total amount of solvent deasphalting residuum and water, of CMC (carboxymethylcellulose) as a grinding auxiliary was first charged in the high-speed agitator, and grinding was performed for 30 min under conditions such that the rotating speed of the agitating element and the rotating speed of the vessel were 2082 rpm and 44 rpm, respectively. The obtained grinds were powdery, and the concentration of the solvent deasphalting residuum was 74.5%. With respect to the obtained grinds, Table 1 lists the particle yield, proportion of particles surviving so as to have a particle diameter of 710 μm or greater, proportion of particles finely ground so as to have a particle diameter of 5.5 μm or less, and particle size distribution and average volume particle diameter of particles having a diameter of less than 710 μm.

It was found from the results that desirable grinds having a broad particle size distribution in which particles having a diameter of 5.5 μm or less were produced in an amount of more than 20% by weight and in which the diameter of particles whose cumulative value of particle size distribution was 90% by weight was greater than 180 μm were obtained in a short period of time.

Thereafter, to the obtained grinds, NSF (naphthalenesulfonic acid/formaldehyde condensate) as a dispersant was added in an amount of 5 g per kg of solvent deasphalting residuum, and attapulgus clay as a stabilizer was added in an amount of 2000 ppm by weight based on the slurry, and agitated. Thus, a viscosity regulation and a stabilization were effected, thereby obtaining a slurry.

With respect to the obtained slurry, the concentration of solvent deasphalting residuum and the apparent viscosity are listed in Table 2. Furthermore, the degree of precipitation was evaluated in the same manner as in Example 2. The results are also given in Table 2.

As a result, it was found that, in Example 3 in which the grinding auxiliary was added prior to the grinding, the desirable slurry can be obtained by the use of dispersant whose amount is about half of that added in Example 2.

Example 4

For preparing 5000 g of a slurry, 3450 g of the solvent deasphalting residuum together with 31% by weight, based on the total amount of solvent deasphalting residuum and water, of water, 300 ppm by weight, based on the total amount of solvent deasphalting residuum and water, of grinding auxiliary (carboxymethylcellulose) and 7 g, per kg of solvent deasphalting residuum, of dispersant (naphthalenesulfonic acid/formaldehyde condensate) was first charged in the high-speed agitator, and grinding was performed for 60 min under conditions such that the rotating speed of the agitating element and the rotating speed of the vessel were 2082 rpm and 44 rpm, respectively. The obtained grinds were in slurry form, and the concentration of the solvent deasphalting residuum was 71.7%. With respect to the grinds of obtained slurry, Table 1 lists the particle yield, proportion of particles surviving so as to have a particle diameter of 710 μm or greater, proportion of particles finely ground so as to have a particle diameter of 5.5 μm or less, and particle size distribution and average volume particle diameter of particles having a diameter of less than 710 μm. The apparent viscosity of the obtained slurry was 500 cP (centipoise).

It was found from the results that desirable grinds having a broad particle size distribution were obtained.

Thereafter, to the obtained slurry, attapulgus clay as a stabilizer was added in an amount of 2000 ppm by weight based on the slurry, and agitated. Thus, a viscosity regulation and a stabilization were effected. With respect to the finally obtained slurry, the concentration of solvent deasphalting residuum and the apparent viscosity are listed in Table 2.

Furthermore, the degree of precipitation of this slurry was evaluated in the same manner as in Example 2. The results are also given in Table 2.

Example 5

For preparing 3000 g of a slurry, 2160 g of the solvent deasphalting residuum together with 28% by weight, based on the total amount of solvent deasphalting residuum and water, of water and 300 ppm by weight, based on the total amount of solvent deasphalting residuum and water, of grinding auxiliary (carboxymethylcellulose) was first charged in the high-speed agitator, and grinding was performed for 15 min under conditions such that the rotating speed of the agitating element and the rotating speed of the vessel were 2082 rpm and 44 rpm, respectively. Subsequently, 5 g, per kg of solvent deasphalting residuum, of NSF (naphthalenesulfonic acid/formaldehyde condensate) as a dispersant was added thereto and agitated for 3 min. Finally, attapulgus clay as a stabilizer was added in an amount of 2000 ppm by weight based on the slurry, and agitated for 1 min. Thus, a viscosity regulation and a stabilization were effected to thereby obtain a slurry. With respect to the grinds of obtained slurry, Table 1 lists the particle yield, proportion of particles surviving so as to have a particle diameter of 710 μm or greater, proportion of particles finely ground so as to have a particle diameter of 5.5 μm or less, and particle size distribution and average volume particle diameter of particles having a diameter of less than 710 μm. It was found from the results that a desirable slurry having a broad particle size distribution was obtained.

Example 6

A slurry was prepared in the same manner as in Example 5, except that the rotating speed of the agitating element was 3470 rpm. With respect to the grinds of obtained slurry, Table 1 lists the particle yield, proportion of particles surviving so as to have a particle diameter of 710 μm or greater, proportion of particles finely ground so as to have a particle diameter of 5.5 μm or less, and particle size distribution and average volume particle diameter of particles having a diameter of less than 710 μm. It was found from the results that a desirable slurry having a broad particle size distribution was obtained.

Example 7

Figure 7:
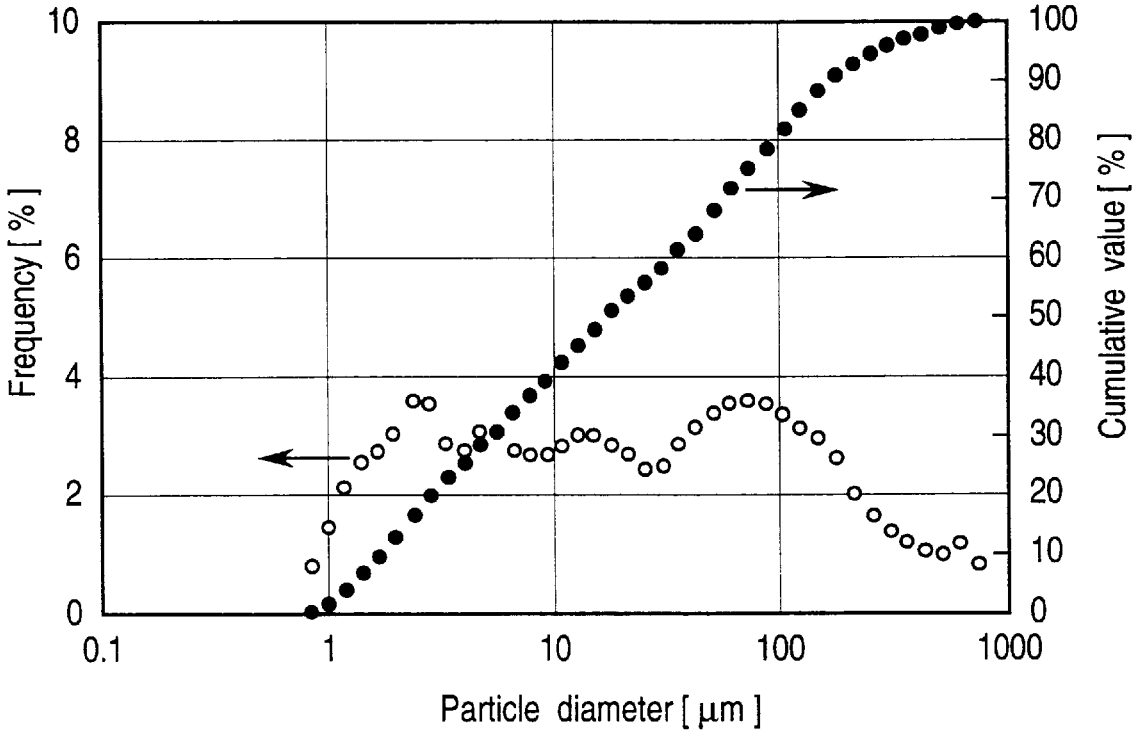
FIG. 7 is a graph showing the particle size distribution obtained in Example 7.

Solvent deasphalting residuum together with 25% by weight, based on the total amount of solvent deasphalting residuum and water, of water and 300 ppm by weight, based on the total amount of solvent deasphalting residuum and water, of grinding auxiliary (carboxymethylcellulose) was first charged in the high-speed agitator, and grinding was performed for 15 min under conditions such that the rotating speed of the agitating element and the rotating speed of the vessel were 3740 rpm and 44 rpm, respectively. Subsequently, water for concentration regulation and 5 g, per kg of solvent deasphalting residuum, of dispersant (naphthalenesulfonic acid/formaldehyde condensate) were added thereto and agitated for 1 to 2 min by means of the agitating element whose rotating speed was 2082 rpm or 3740 rpm. Thereafter, a stabilizer was added and agitated to thereby obtain a slurry. The concentration of solvent deasphalting residuum in obtained slurry was about 75% by weight. The particle size distribution of obtained slurry is shown in FIG. 7. This figure shows that a desirable slurry having a broad particle size distribution was obtained.

Comparative Example 1

A ball mill grinding apparatus was used in the grinding operation.

For preparing 600 g of a slurry, 420 g of the solvent deasphalting residuum together with 180 g of water, 300 ppm by weight, based on the total amount of solvent deasphalting residuum and water, of grinding auxiliary (carboxymethylcellulose) and 9 g, per kg of solvent deasphalting residuum, of dispersant (naphthalenesulfonic acid/formaldehyde condensate) was charged in the ball mill grinding apparatus, and grinding was performed for 45 min under conditions such that the rotating speed of the vessel was 60 rpm. The obtained grinds were in slurry form, and the concentration of the solvent deasphalting residuum was 69.0% by weight. With respect to the grinds of obtained slurry, Table 1 lists the particle yield, proportion of particles surviving so as to have a particle diameter of 710 μm or greater, proportion of particles finely ground so as to have a particle diameter of 5.5 μm or less, and particle size distribution and average volume particle diameter of particles having a diameter of less than 710 μm. The apparent viscosity of the obtained slurry was 1128 cP (centipoise).

Thereafter, to the obtained slurry, attapulgus clay as a stabilizer was added in an amount of 2000 ppm by weight based on the slurry, and agitated. Thus, a viscosity regulation and a stabilization were effected. With respect to the finally obtained slurry, the concentration of solvent deasphalting residuum and the apparent viscosity are listed in Table 2. Furthermore, the degree of precipitation of this slurry was evaluated in the same manner as in Example 2. The results are also given in Table 2.

Comparative Example 2

A ball mill grinding apparatus was used in the grinding operation.

Figure 8:
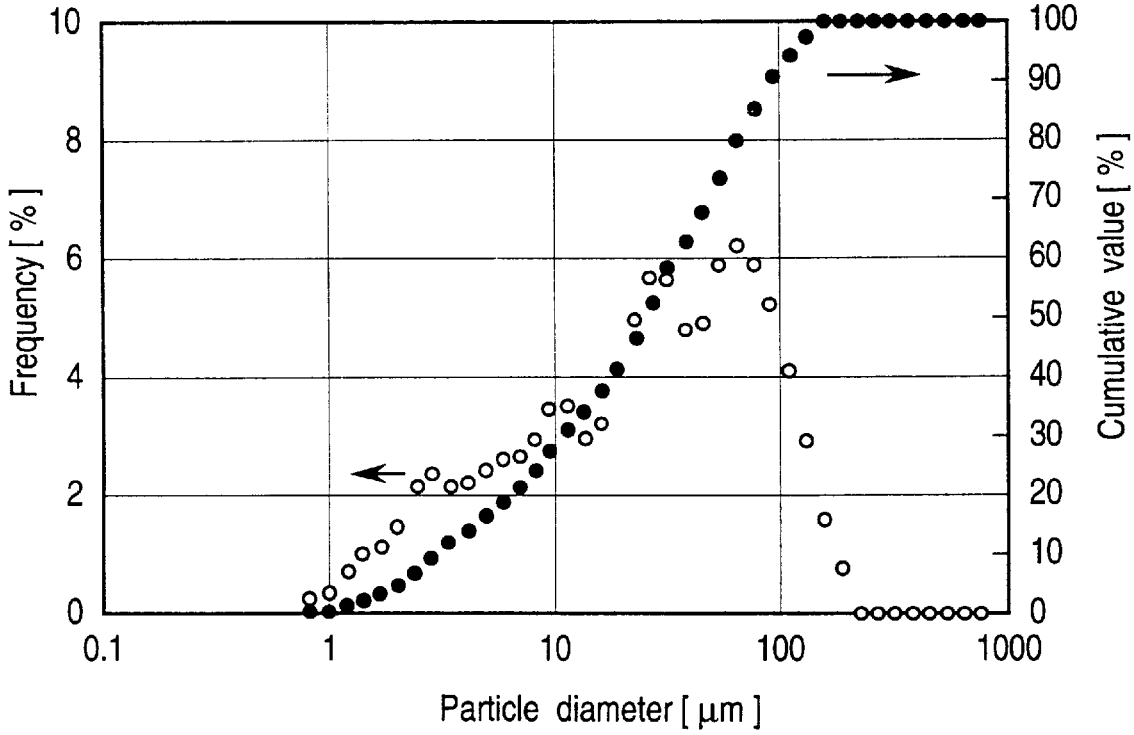
FIG. 8 is a graph showing the particle size distribution obtained in Comparative Example 2.

The solvent deasphalting residuum together with 30% by weight, based on the total amount of solvent deasphalting residuum and water, of water, 300 ppm by weight, based on the total amount of solvent deasphalting residuum and water, of grinding auxiliary (carboxymethylcellulose) and 9 g, per kg of solvent deasphalting residuum, of dispersant (naphthalenesulfonic acid/formaldehyde condensate) was charged in the ball mill grinding apparatus, and grinding was performed for 20 min under conditions such that the rotating speed of the vessel was 41 rpm. The obtained grinds were in slurry form. With respect to the obtained slurry, the concentration of solvent deasphalting residuum and the apparent viscosity are listed in Table 2. Furthermore, the particle size distribution of obtained slurry is shown in FIG. 8. FIG. 8 shows that the peak of particle size distribution of obtained slurry is deviated toward the large diameter side and that a desirable particle size distribution was not obtained. It is also shown that the particle size distribution of obtained slurry was narrow as compared with that of Example 7, attesting to poor fluidity.

It is apparent that, in Examples 1 to 7 in which the slurry was produced by the process of the present invention, the grinds exhibited broad particle size distribution and excellent fluidity as compared with those of Comparative Examples 1 and 2 in which the ball mill grinding apparatus was employed and further that, in the Examples, the petroleum residuum-water slurry having a high concentration of solvent deasphalting residuum and a high combustibility as compared with those of Comparative Example 1 was obtained.

TABLE 1

| | Example 1 | Example 2 | Example 3 | Example 4 | Example 5 | Example 6 | Comp. Ex. 1 |
|---|---|---|---|---|---|---|---|
| Yield of grinds | | | | | | | |
| +710 μm (wt %) | 17.8 | 14.6 | 11.6 | 11.0 | 14.6 | 10.5 | 0 |
| −5.5 μm (wt %) | 17.8 | 23.4 | 24.4 | 16.8 | 23.9 | 26.4 | 20 |
| −710 μm particle size distribution | | | | | | | |
| 10% (μm) | 3.6 | 3.4 | 3.1 | 2.1 | 3.13 | 2.08 | 2.0 |
| 50% (μm) | 18.5 | 18.8 | 19.2 | 29.6 | 16.62 | 20.50 | 20 |

TABLE 1-continued

| | Example 1 | Example 2 | Example 3 | Example 4 | Example 5 | Example 6 | Comp. Ex. 1 |
|---|---|---|---|---|---|---|---|
| 90% (μm) | 89.2 | 180.3 | 190.0 | 132.9 | 376.49 | 202.54 | 150 |
| Av. vol. particle diameter (μm) | 34.3 | 35.3 | 46.1 | 55.4 | 95.81 | 73.18 | 30 |

TABLE 2

| | Example 2 | Example 3 | Example 4 | Example 7 | Comp. Ex. 1 | Comp. Ex. 2 |
|---|---|---|---|---|---|---|
| Concn. (wt %) | 71.5 | 75.0 | 72.7 | 74.94 | 69.0 | 69.0 |
| Apparent vis. (cp) | 900 | 950 | 980 | 642 | 1128 | 950 |
| Vib. stability index (%/day) | 1.2 | 1.2 | 2.4 | — | 1.2 | — |

What is claimed is:

1. A process for producing a petroleum residuum-water slurry which comprises the steps of:

charging petroleum residuum into a high-speed agitator having a vessel equipped, at its bottom, with at least one agitating element, wherein the agitating element has a rotary central axis located apart from a central axis of the vessel of the high-speed agitator, adding water in an amount of 25% to 50% by weight based on the total of the petroleum residuum and water, and rotating the agitating element at a high speed to thereby grind the petroleum residuum, wherein not only are water and a dispersant added to the petroleum residuum prior to, during or after the grinding of the petroleum residuum but also a grinding auxiliary is added to the petroleum residuum prior to or during the grinding of the petroleum residuum, followed by agitation together with the petroleum residuum, thereby obtaining a petroleum residuum-water slurry.

2. The process as claimed in claim 1, wherein the petroleum residuum has a softening point of 120 to 200° C.

3. The process as claimed in claim 2, wherein the petroleum residuum is a residuum obtained by subjecting a vacuum residual oil to a solvent deasphalting.

4. The process as claimed in claim 3, wherein the vessel of the high-speed agitator is rotated in direction reverse to that of the agitating element.

5. The process as claimed in claim 4, wherein the agitating element has a rotary central axis located apart from the central axis of the vessel of the high-speed agitator.

6. The process as claimed in claim 5, wherein a central axis of the vessel of the high-speed agitator and a rotary central axis of the agitating element are arranged in substantially parallel relationship to each other and are both inclined.

7. The process as claimed in claim 6, wherein the vessel of the high-speed agitator has a corner fitted with a partition capable of preventing retention of the petroleum residuum.

8. The process as claimed in claim 7, wherein the petroleum residuum-water slurry contains particles whose diameter is not greater than 5.5 μm in an amount of 15 to 40% by weight and particles whose diameter is not greater than 720 μm in an amount of at least 80% by weight.

9. The process as claimed in claim 8, wherein the water is added in an amount of 25 to 50% by weight based on the total of the petroleum residuum and water.

10. The process as claimed in claim 9, further comprising the step of passing the obtained petroleum residuum-water slurry through a strainer.

11. The process as claimed in claim 10, further comprising the step of adding a stabilizer to the obtained petroleum residuum-water slurry.

12. The process as claimed in claim 1, wherein the petroleum residuum is a residuum obtained by subjecting a vacuum residual oil to a solvent deasphalting.

13. The process as claimed in claim 1, wherein the vessel of the high-speed agitator is rotated in direction reverse to that of the agitating element.

14. The process as claimed in claim 1, wherein a central axis of the vessel of the high-speed agitator and a rotary central axis of the agitating element are arranged in substantially parallel relationship to each other and are both inclined.

15. The process as claimed in claim 1, wherein the vessel of the high-speed agitator has a corner fitted with a partition capable of preventing retention of the petroleum residuum.

16. The process as claimed in claim 1, wherein the petroleum residuum-water slurry contains particles whose diameter is not greater than 5.5 μm in an amount of 15 to 40% by weight and particles whose diameter is not greater than 710 μm in an amount of at least 80% by weight.

17. The process as claimed in claim 1, further comprising the step of passing the obtained petroleum residuum-water slurry through a strainer.

18. The process as claimed in claim 1, further comprising the step of adding a stabilizer to the obtained petroleum residuum-water slurry.

* * * * *

UNITED STATES PATENT AND TRADEMARK OFFICE

CERTIFICATE OF CORRECTION

PATENT NO. : 6,183,629 B1
DATED : February 6, 2001
INVENTOR(S) : Shoichi Bando and Makoto Inomata It is certified that error appears in the above-identified patent and that said Letters Patent is hereby corrected as shown below:

Column 1,
Line 57, after "difficult" insert -- ; --.

Column 8,
Line 51, "so at" should read -- so that --.

Column 10,
Line 38, "with respect" should read -- With respect --.

Signed and Sealed this

Second Day of October, 2001

*Attest:*

Nicholas P. Godici

*Attesting Officer*

NICHOLAS P. GODICI
*Acting Director of the United States Patent and Trademark Office*